US008668286B2

(12) United States Patent
Gasser

(10) Patent No.: US 8,668,286 B2
(45) Date of Patent: Mar. 11, 2014

(54) RAIL SYSTEM FOR DRAWERS

(75) Inventor: Ingo Gasser, Hoechst (AT)

(73) Assignee: Julius Blum GmbH, Hoechst (AT)

( * ) Notice: Subject to any disclaimer, the term of this patent is extended or adjusted under 35 U.S.C. 154(b) by 0 days.

(21) Appl. No.: 13/487,534

(22) Filed: Jun. 4, 2012

(65) Prior Publication Data

US 2012/0237144 A1 Sep. 20, 2012

Related U.S. Application Data

(63) Continuation of application No. PCT/AT2010/000424, filed on Nov. 8, 2010.

(30) Foreign Application Priority Data

Dec. 23, 2009 (AT) ..... A 2028/2009

(51) Int. Cl.
*A47B 95/00* (2006.01)

(52) U.S. Cl.
USPC ..... 312/331

(58) Field of Classification Search
USPC ..... 312/331, 334.7, 334.8, 402, 404, 408
See application file for complete search history.

(56) References Cited

U.S. PATENT DOCUMENTS

| | | | | |
|---|---|---|---|---|
| 3,323,853 | A | 6/1967 | Stark | |
| 3,794,401 | A * | 2/1974 | Dean et al. | 312/323 |
| 4,436,989 | A * | 3/1984 | Schuldt | 235/22 |
| 5,399,010 | A * | 3/1995 | McClung et al. | 312/334.1 |
| 6,431,386 | B1 * | 8/2002 | Hofman et al. | 220/481 |
| 6,672,016 | B2 * | 1/2004 | Janesky | 52/169.5 |
| 7,213,896 | B2 * | 5/2007 | Chi | 312/334.8 |
| 8,016,373 | B2 * | 9/2011 | Weber et al. | 312/331 |
| 8,210,623 | B2 * | 7/2012 | Chen et al. | 312/331 |
| 8,210,625 | B2 * | 7/2012 | Rotter et al. | 312/402 |
| 8,366,215 | B2 * | 2/2013 | Chen | 312/331 |
| 8,376,481 | B2 * | 2/2013 | Lee | 312/402 |
| 2005/0160854 | A1 * | 7/2005 | Rotter | 74/422 |
| 2006/0108899 | A1 * | 5/2006 | Jin | 312/257.1 |
| 2007/0101539 | A1 | 5/2007 | Sutterlutti et al. | |
| 2008/0211365 | A1 | 9/2008 | Moll et al. | |

FOREIGN PATENT DOCUMENTS

| | | |
|---|---|---|
| CN | 201299316 | 9/2009 |
| CN | 201356273 | 12/2009 |
| DE | 38 34 688 | 11/1989 |

(Continued)

OTHER PUBLICATIONS

International Search Report issued Mar. 1, 2011, in International (PCT) Application No. PCT/AT2010/000424.

(Continued)

*Primary Examiner* — Matthew Ing
(74) *Attorney, Agent, or Firm* — Wenderoth, Lind & Ponack, L.L.P.

(57) ABSTRACT

The invention relates to a rail system for drawers, comprising a body rail to be fastened to a furniture body and at least one drawer rail that can be moved relative to the body rail, and comprising at least one gear rack arranged on a rail of the rail system, wherein the gear rack can be pivoted or bent relative to the rail to which said gear rack is fastened about an imaginary axis (A) extending in the pull-out direction of the rail and thus is mounted such that the gear rack can be moved vertically to a limited extent.

16 Claims, 6 Drawing Sheets

(56) References Cited

FOREIGN PATENT DOCUMENTS

| | | |
|---|---|---|
| DE | 43 01 326 | 8/1993 |
| DE | 42 20 527 | 1/1994 |
| DE | 20 2005 006 716 | 8/2005 |
| EP | 0 051 688 | 5/1982 |
| EP | 0 718 574 | 6/1996 |
| EP | 1 036 526 | 9/2000 |

OTHER PUBLICATIONS

Chinese Office Action (OA) issued Sep. 2, 2013 in Chinese Patent Application No. 201080058382.3.

* cited by examiner

RAIL SYSTEM FOR DRAWERS

This application is a continuation of International Application No. PCT/AT2010/000424, filed Nov. 8, 2010.

BACKGROUND OF THE INVENTION

The present invention concerns a rail system for drawers, comprising a carcass rail to be fastened to a furniture carcass and at least one drawer rail movable relative to the carcass rail, and at least one rack arranged on a rail of the rail system.

The invention further concerns an arrangement of two rail systems of the kind to be described, which are to be mounted at opposite side walls of an article of furniture and which are connected together for the transmission of a synchronous movement by way of a synchronisation bar.

Such rail systems are usually employed to synchronize the movement of two drawer extension guides which are in opposite relationship on an article of furniture, relative to each other, by a rack-and-pinion arrangement. That permits precise parallel guidance of an extendable furniture part—in particular of a drawer. That parallel guidance relative to a furniture carcass is advantageous in particular when very narrow or very wide drawers are to be moved, in which case lateral tilting of the drawer is substantially prevented by the parallel guidance effect. The movement of the oppositely disposed rail systems is frequently synchronized by way of a synchronization bar extending transversely to the extension direction. Mounted at both end regions of the synchronization bar are pinions which respectively engage into the racks of the rail systems to be synchronized. EP 1 036 526 B1 discloses such a parallel guide assembly having a rack-and-pinion arrangement. With known rail systems, the positively locking connection between the rack and the pinion can lead to jamming of the rail system and thus unwanted blocking of the drawer in normal use.

DE 43 01 326 A1 describes a drawer extension arrangement, wherein toothed racks are mounted movably on the carcass rail and the drawer rail so that they can project freely over their length from the respective fastening end. The flexural axis of the rack extends in that case substantially at a right angle to the extension direction of the rails.

The object of the present invention is to propose a rail system of the general kind set forth above, having improved running properties.

SUMMARY OF THE INVENTION

According to the invention, the above object is attained by the features of the present invention. Further advantageous configurations of the invention are recited in the appendant claims.

Thus, the rack is pivotable or bendable (i.e., pivotable) with respect to the rail to which it is fastened about a notional axis extending in the extension direction of the rail and is thus mounted limitedly movably heightwise.

A limitedly heightwise movable mounting of the rack provides that, when pulling out and pushing in the drawer, it is possible to avoid twisting between the pinion and the rack, as the rack which is mounted resiliently in a heightwise direction can yield with respect to the pinion in possible jamming situations. However, the positively locking connection between the pinion and the rack is maintained. The rack can therefore be elastically preloaded towards the pinion, either by inherent elasticity or also by the force of a spring.

In an embodiment, the rack can be mounted limitedly movably heightwise by way of a resiliently yielding portion.

The resiliently yielding region is such that, after vertical deflection, the rack is automatically moved back into the original starting position again.

In another embodiment of the invention, the rack can be connected to one of the rails by way of a film hinge. Such an integral hinge connection between the rack and the stationary or heightwisely immobile part of the rail can be implemented by a thin-wall connection (for example, by a groove extending in a longitudinal direction of the rail). It is equally advantageously possible to use a flexural hinge by which the rack is pivotable about a longitudinal axis.

In a possible development of the invention, the rack can be arranged or provided on an adaptor, wherein the adaptor is connected or can be releasably connected to one of the rails by at least one fastening location. In that respect, it may be desirable if the adaptor is substantially in the form of an L-profile, wherein in the mounted position one leg of the L-profile bears against a vertical limb of the carcass rail and another leg of the L-profile bears against a horizontal limb of the carcass rail. Simple fastening can be effected by the adaptor being fastened at the same time as mounting of the rail system to the furniture carcass.

It is to be noted that at least one pinion engages into the rack of the rail system. The pinion engaging into the rack can be directly or indirectly coupled to the synchronization bar, as a parallel guidance pinion. In particular, there can be a non-rotatable connection between the pinion and the synchronization bar.

In a first embodiment, the rack is arranged on the carcass rail or the furniture carcass and the pinion is mounted on the drawer rail or the drawer. In an alternative embodiment, the rack can be arranged on the drawer rail or the drawer and the pinion can be mounted on the carcass rail or the furniture carcass.

BRIEF DESCRIPTION OF THE DRAWINGS

Further details and advantages of the present invention are described by means of the specific description hereinafter, with reference to the drawings in which.

DETAILED DESCRIPTION OF THE INVENTION

Figure 1:
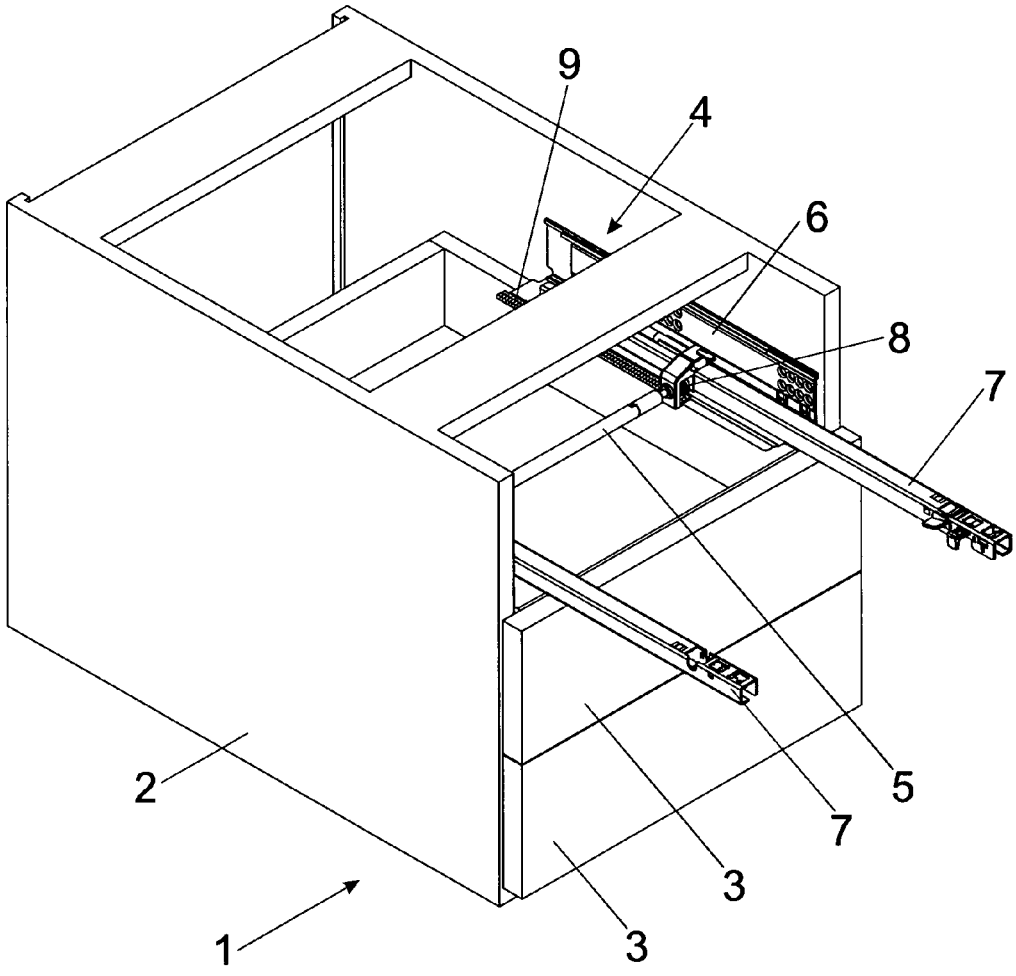
FIG. 1 shows a perspective view of an article of furniture with drawers which are mounted displaceably relative to a furniture carcass by way of oppositely disposed rail systems.

FIG. 1 shows a perspective view of an article of furniture 1 having a furniture carcass 2 in cabinet form, with drawers 3 mounted displaceably relative to the furniture carcass 2 by way of rail systems 4. Disposed on each side of the drawer 3 is a rail system 4, wherein the two rail systems 4 are to be fastened to mutually opposite side walls of the furniture carcass 2. It is possible to see a synchronization bar 5 in the form of a torsion shaft, extending transversely relative to the extension direction of the drawer 3. The movements of the two rail systems 4 can be synchronized relative to each other by the synchronization bar 5 whereby it is also possible to provide for precise parallel guidance of the drawer 3 relative to the furniture carcass 2. The two rail systems 4 respectively have a carcass rail 6 to be mounted to the furniture carcass 2, and at least one drawer rail 7 displaceable relative to the carcass rail 6. The purpose of the synchronization bar 5 is to synchronize a movement of the left-hand and right-hand drawer rails 7 relative to each other so that the drawer 3 can be pulled out of the furniture carcass 2 and pushed thereinto without lateral tilting. At the end regions, the synchronization bar 5 has at least one rotatably mounted pinion 8 meshing with a rack 9 of the rail system 4. It will be appreciated that as a mechanical reversal, it is also possible for the rack 9 to be mounted to the drawer 3 or to the drawer rail 7 and for the associated pinion 8 to be mounted to the carcass rail 6 or the furniture carcass 2.

Figure 2A:
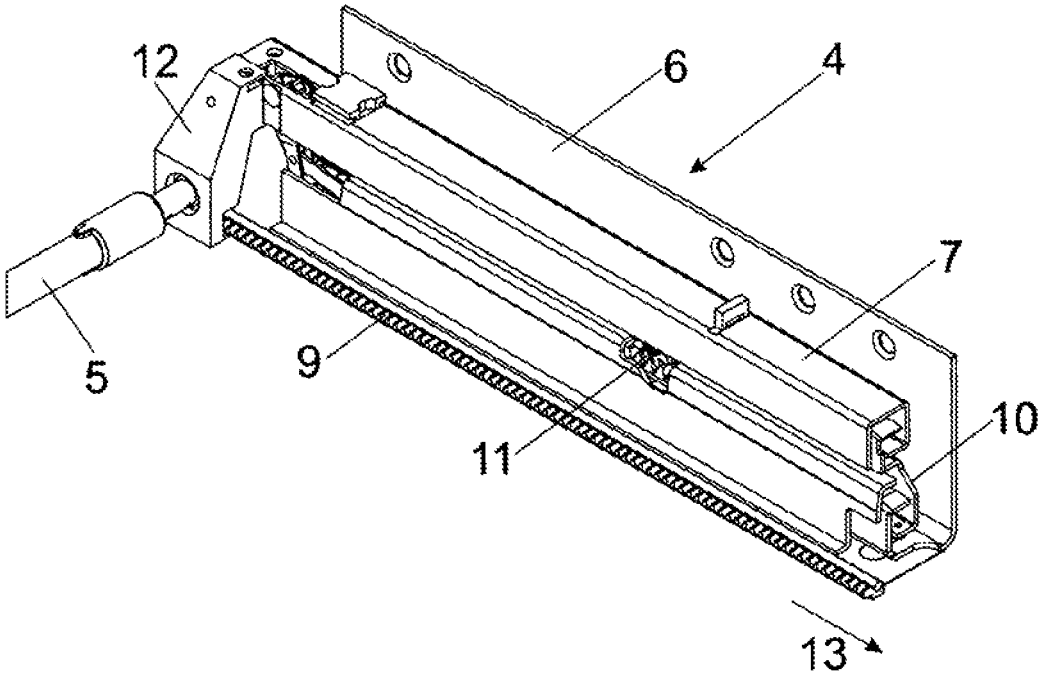
FIGS. 2*a*, 2*b* show a perspective view of a rail system, wherein the rack provided for synchronization of the movement of the drawer is arranged on the carcass rail, and a perspective view of a rack arranged on the drawer.

FIG. 2*a* shows a perspective view of a rail system 4 with the carcass rail 6 to be fastened to the furniture carcass 2, and the displaceable drawer rail 7. A middle rail 10 is mounted displaceably between the carcass rail 6 and the drawer rail 7 in a known manner in order to permit full extension of the drawer 3 relative to the furniture carcass 2. For synchronization of the rail movement of an individual rail system 4, there is provided a synchronization device 11 with a pinion mounted rotatably to the middle rail 10 and which can control the movable rails 7, 10 relative to each other in accordance with a progressive action slide, so that the drawer rail 7 moves at approximately twice the speed of the middle rail 10. A mounting block 12 is fixedly connected to the extendable drawer rail 7. The pinion 8 shown in FIG. 1 which engages into the rack 9 is accommodated in that mounting block 12. The rack 9 extends in the extension direction 13 of the drawer 3 and extends substantially over the entire length of one of the rails 6, 7, 10. In the present case, the rack 9 extends over the entire length of the carcass rail 6. It will be appreciated that it would also be possible for the rack 9 to also extend only over a part of the length of the rail 6, 7, 10. When the drawer 3 is pulled out in the extension direction 13, the drawer rail 7 is moved forwardly together with the mounting block 12 arranged thereon and together with the synchronization bar 5 along the rack 9, with the pinion 8 also running along the rack 9. The movement of the pinions 8 of two rail systems 4 in opposite relationship on the furniture carcass 2 can be synchronized by the synchronization bar 5.

Figure 2B:
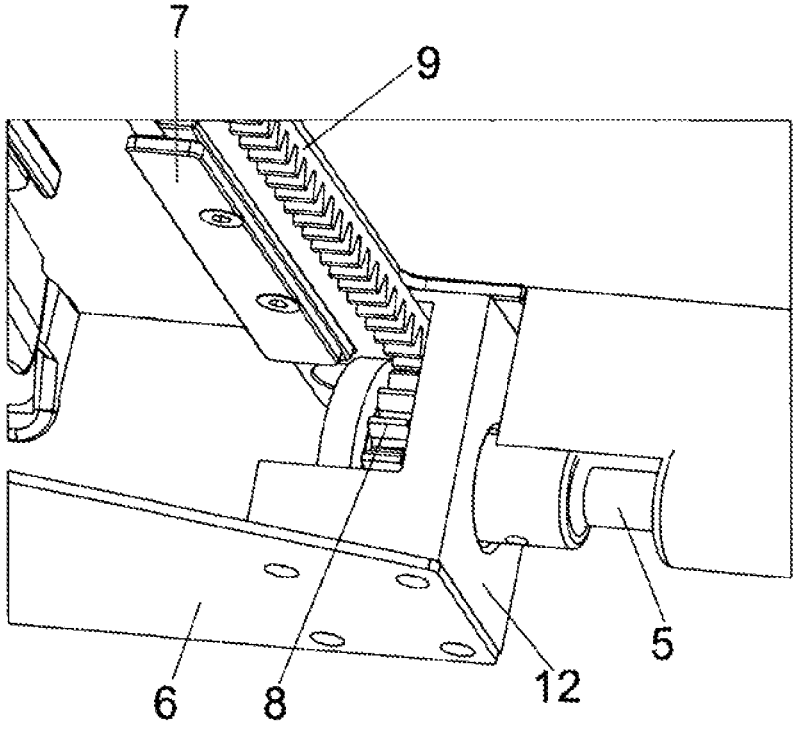

FIG. 2*b* only diagrammatically shows the mechanical reversal thereof, namely, showing that the mounting block 12 with the pinion 8 is mounted to the carcass rail 6 (or alternatively to the furniture carcass 2) and the rack 9 is mounted to the drawer rail 7 (or also to the drawer 3).

Figure 3A:
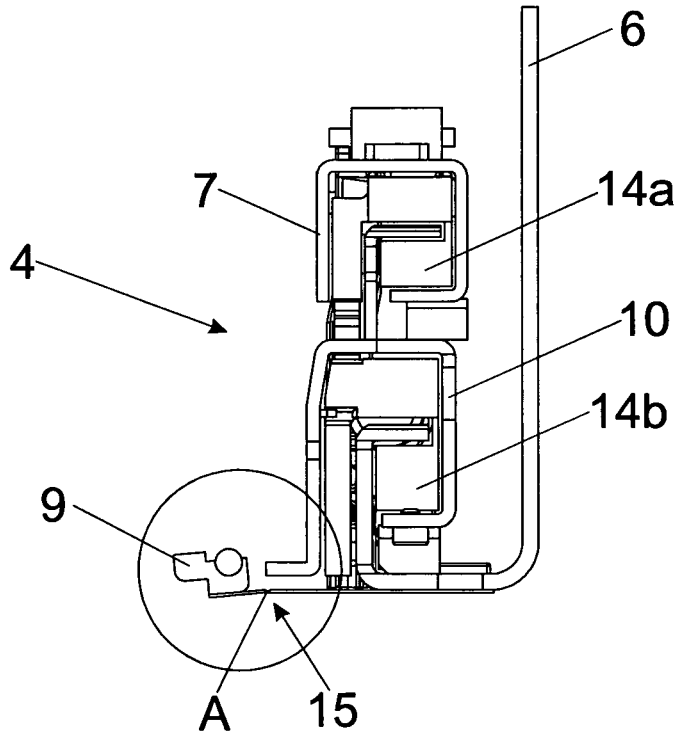
FIGS. 3*a*, 3*b* show a sectional view of the rail system, wherein the rack is connected to the carcass rail by way of a film hinge, and an enlarged detail view thereof.
Figure 3B:
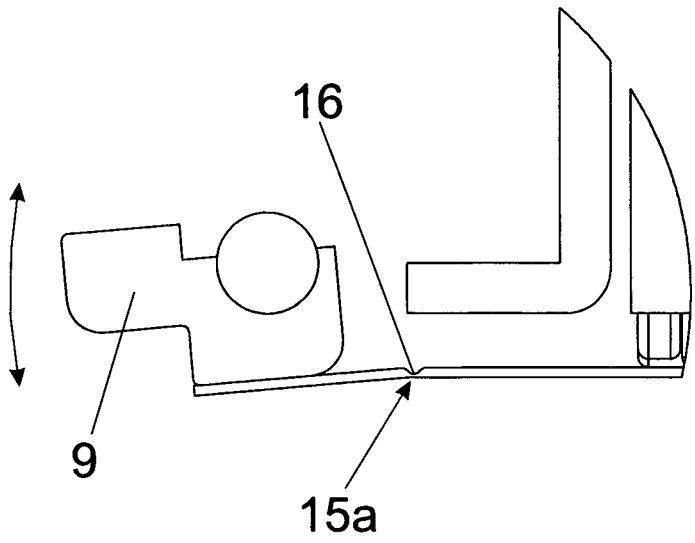

FIG. 3*a* shows a vertical section through the rail system 4 with the stationary carcass rail 6, the middle rail 10 movable relative to the carcass rail 6, and the drawer rail 7. Displaceable running carriages 14*a*, 14*b* with load-transmitting rolling bodies are mounted between the rails 6, 7, 10. In the illustrated embodiment, the rack 9 is connected by a resilient region 15 to the stationary part of the carcass rail 6. FIG. 3*b* shows an enlarged view of the region circled in FIG. 3*a*. The resiliently yielding region 15 is embodied in the illustrated embodiment by a film hinge 15*a* (that is to say, by a local weakening in the rail 6) extending in the longitudinal direction of the rail 6, 7, 10, in the form of a groove 16, thereby providing for partial flexibility (pivoting) of the rack 9 in an upward direction. The risk of jamming as between the pinion 8 and the rack 9 can be substantially reduced in that way. The heightwisely movable mounting of the rack 9 can also be implemented by way of a flexural pivoting hinge so that the rack 9 is mounted limitedly heightwisely movably (i.e., mounted so as to have some limited movement in the heightwise direction after mounting) as indicated by the illustrated double-headed arrow. The rack 9 is thus pivotable or bendable (i.e., pivotable) with respect to the rail 6 about a notional (longitudinal extension) axis (A) extending in the extension direction 13 (FIG. 2*a*) and is thus mounted limitedly movably heightwise. It is to be noted that the hinge or axis (A) does not have to be at a well-defined location (for example by a weakening of the film hinge). Rather the rack 9 can be of an elastically bendable configuration in itself and can thus bend (pivot) downwardly at the free longitudinal edge.

Figure 4A:
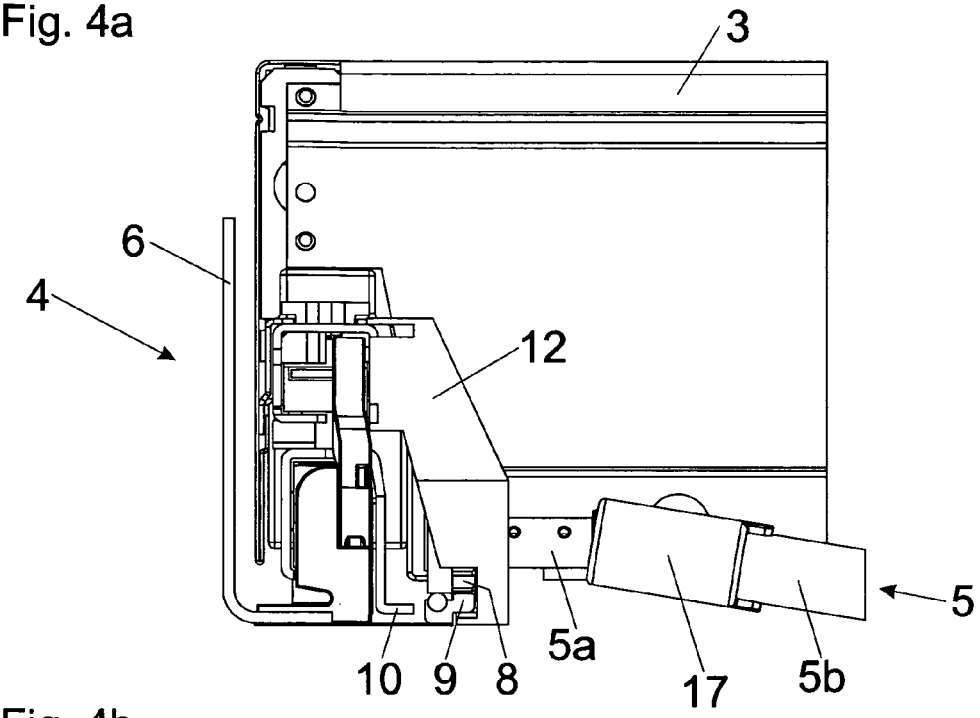
FIGS. 4*a*, 4*b* show a view from the rear and a perspective view of the rail system.

FIG. 4*a* shows a view from the rear of the drawer 3 connected to the rail system 4. The mounting block 12 is fixedly connected to the drawer rail 7, the pinion 8 engaging into the rack 9 connected to the carcass rail 6. The rotary movement of the pinions 8 of two rail systems 4 in opposite relationship on a furniture carcass 2 is synchronized relative to each other by the synchronization bar 5. In the illustrated embodiment, the synchronization bar 5 has a two-part structure and includes two shaft portions 5*a* and 5*b* connected together by a joint 17. The joint 17 of the synchronization bar 5 makes it possible to compensate for installation tolerances, height errors and possible angular displacement of two oppositely disposed rail systems 4. The joint 17 has such a construction that a rotary movement of the two shaft portions 5*a*, 5*b* relative to each other is possible.

Figure 4B:
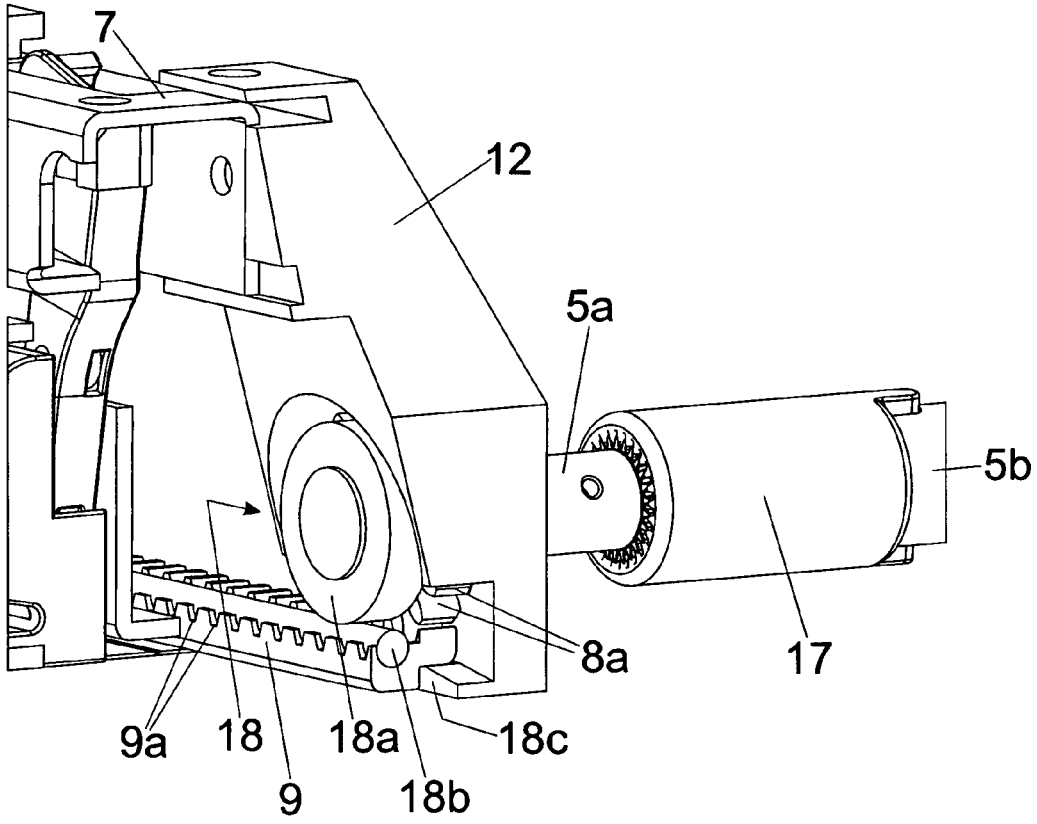

FIG. 4*b* shows a perspective view from the rear of the rail system 4 in the closed position. The rail system 4 has a limiting device 18 which limits the depth of engagement of the pinion 8 relative to the rack 9 in such a way that the teeth 8*a* of the pinion 8 only partially engage into the corresponding tooth gaps 9*a* in the rack 9. The limiting device 18 includes a runner wheel 18*a*—preferably in the form of a friction wheel—which is mounted rotatably coaxially relative to the pinion 8. The diameter of the runner wheel 18*a* is smaller than that of the pinion 8. It is possible to see a—preferably elastically yielding—spacer part 18*b* which can extend substantially over the entire length of the rack 9. The runner wheel 18*a* runs on or along a running surface of the spacer part 18*b* which is made of plastic material, whereby the teeth 8*a* of the pinion 8 cannot engage completely into the tooth gaps 9*a* in the rack 9. That makes it possible to effectively prevent jamming between the pinion 8 and the rack 9, thereby also preventing the risk of jamming of the drawer 3 in normal use. The limiting device 18 also includes a limb 18*c* which engages under the rack 8 and by which the lift-off height of the pinion 8 relative to the rack 9 can be limited. In the illustrated embodiment, the limb 18*c* is part of the mounting block 12 and can be moved along the stationary rack 9 upon movement of the drawer 3. The plastic spacer part 18*b* acts virtually as a cushion between the pinion 8 and the rack 9 whereby the pinion 8 is guided in a play-free fashion and with a low level of noise.

Figure 5A:
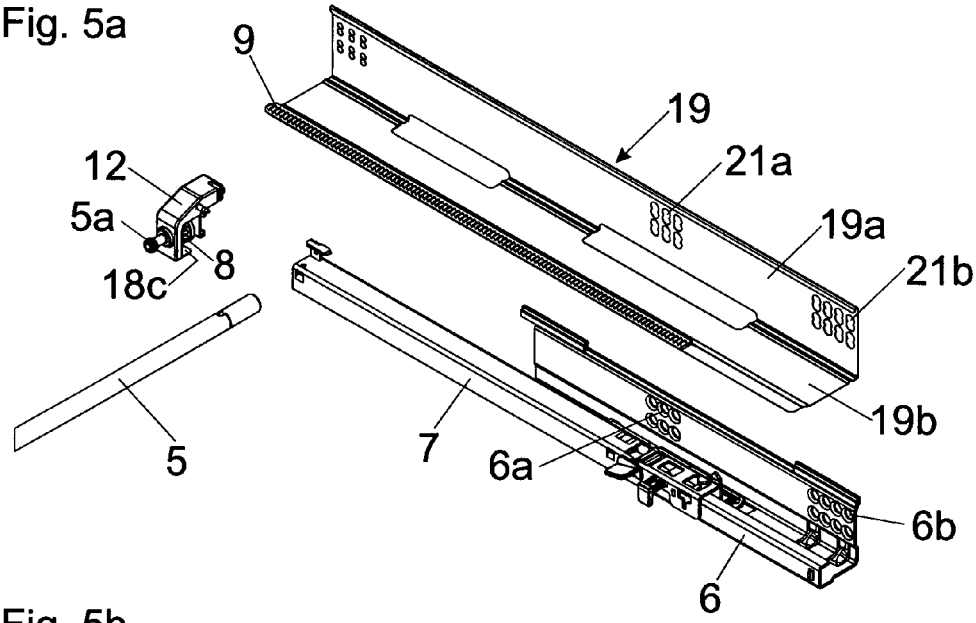
FIGS. 5*a*, 5*b* show an embodiment of the invention with an adaptor carrying the rack as a perspective exploded view and the mounted position of the rail system as a sectional view.

FIG. 5*a* shows an exploded view of a rail system 4, wherein the rack 9 is provided on a substantially L-shaped adaptor 19. The adaptor 19 includes two legs 19*a* and 19*b* substantially arranged at a right angle to each other, the rack 9 being mounted on the leg 19*b*. The adaptor 19 is also suitable in particular for equipping a commercially available extension guide for drawers 3—comprising a carcass rail 6 and at least one drawer rail 7 displaceable relative thereto—with a rack 9, as from the factory, or also subsequently. The adaptor 19 can be made from plastic material or metal. The adaptor has fastening locations 21*a* and 21*b* aligned with the fastening locations 16*a*, 16*b* of the carcass rail 6. In the mounting operation, therefore, screws are passed through the fastening locations 6*a*, 6*b* of the carcass rail 6 and through the fastening locations 21*a*, 21*b* of the adaptor 19 and screwed into the furniture carcass 2. The fastening locations 21*a*, 21*b* of the adaptor 19 are only a few of the possible configurations. In particular, it is also possible to provide a snap connection between the adaptor 19 and the rail system 4.

Figure 5B:
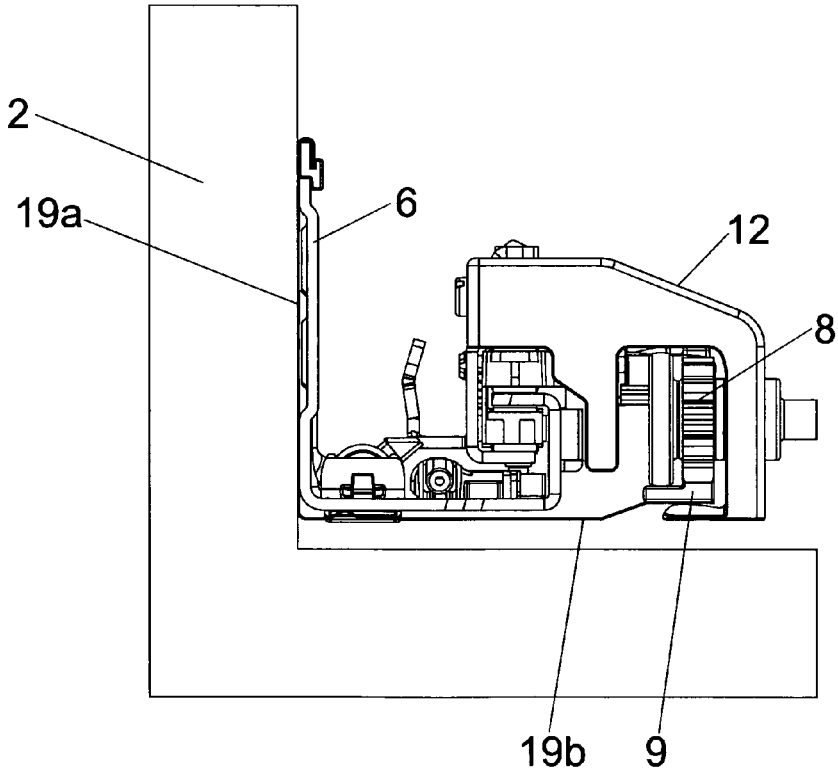

FIG. 5*b* shows the carcass rail 6 of FIG. 5*a*, fastened to the furniture carcass 2. In the mounting operation, the leg 19*a* of the adaptor 19 is screwed between the carcass rail 6 and the furniture carcass 2. The lower leg 19*b* of the adaptor is resilient so that the rack 9 mounted thereon is mounted limitedly heightwisely movably in order thus to prevent jamming between the pinion 8 and the rack 9 during the movement of the drawer 2.

Figure 6A:
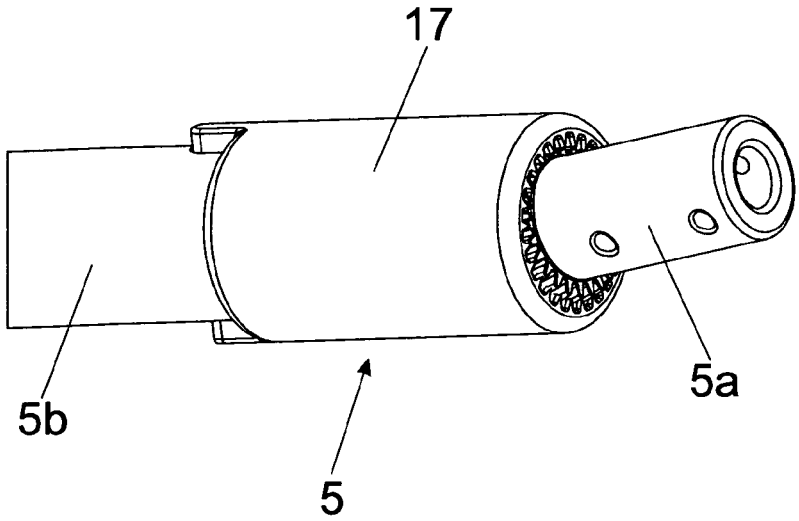
FIGS. 6*a*, 6*b* show a possible embodiment of a synchronization bar provided for synchronizing a movement of two rail systems in opposite relationship on a furniture carcass, wherein the synchronization bar has a hinge.
Figure 6B:
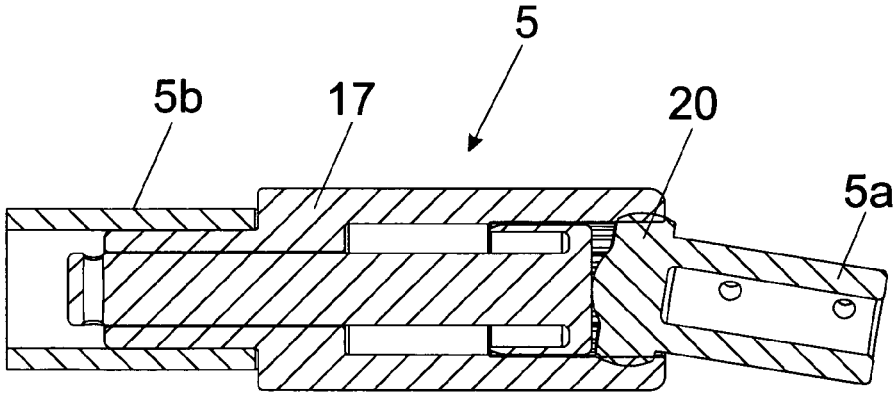

FIG. 6*a* shows an embodiment of a synchronization bar 5 provided for synchronization of two rail systems 4 in opposite relationship on a furniture carcass 2. The synchronization bar 5 is of a two part configuration and includes two shaft portions 5*a* and 5*b* connected together by way of a joint 17. The joint 17 permits radial mobility of the two shaft portions 5*a* and 5*b* relative to each other. The joint 17 can be in the form of a shaft joint, in particular a cardan joint or a ball joint. It is possible in that way to compensate for the relative displacement of two rail systems 4 in opposite relationship on a furniture carcass 2. FIG. 6*b* shows a sectional view of the synchronization bar 5 with the two shaft portions 5*a*, 5*b* of FIG. 6*a*. It is possible to see the gear head 20 which is arranged on the shaft portion 5*a* and which engages into a corresponding tooth arrangement of the joint 17.

The present invention is not limited to the illustrated embodiments and includes or extends to all technical equivalents which can fall within the scope of the claims appended hereto. The positional references adopted in the description such as for example up, down, lateral and so forth are also related to the directly described and illustrated Figure and are to be appropriately transferred to the new position upon a change in position.

The invention claimed is:

1. A rail system for drawers, comprising:

a carcass rail to be fastened to a furniture carcass;

a drawer rail movable relative to said carcass rail; and a rack arranged on one of said carcass rail or said drawer rail, said rack being mounted so as to be pivotable about a longitudinal extension axis of said rail system with respect to said one of said carcass rail or said drawer rail such that said rack is limitedly movable in a heightwise direction in a mounted condition, said longitudinal extension axis extending in an extension direction of said rail system.

2. The rail system according to claim 1, wherein said rack is mounted by a resiliently yielding portion so as to be pivotable about the longitudinal extension axis of said rail system and limitedly movable in the heightwise direction.

3. The rail system according to claim 1, wherein said rack is connected to said one of said carcass rail or said drawer rail by a film hinge.

4. The rail system according to claim 1, further comprising an adaptor to be releasably connected to said one of said carcass rail or said drawer rail at a fastening location, said rack being arranged on said adaptor.

5. The rail system according to claim 4, wherein said adaptor has a substantially L-shaped profile, said adaptor being mounted such that a first leg of said L-shaped profile bears against a vertical limb of said carcass rail, and a second leg of said L-shaped profile bears against a horizontal limb of said carcass rail.

6. The rail system according to claim 4, wherein said adaptor is configured to be screwed to said one of said carcass rail or said drawer rail so as to be located between said carcass rail and the furniture carcass.

7. The rail system according to claim 1, further comprising a pinion engaging into said rack.

8. The rail system according to claim 7, wherein said rack is arranged on said carcass rail, and said pinion is mounted to one of said drawer rail or a drawer.

9. The rail system according to claim 7, wherein said rack is arranged on said drawer rail, and said pinion is mounted to one of said carcass rail or the furniture carcass.

10. The rail system according to claim 7, further comprising a limiting device configured to limit a depth of engagement of said pinion relative to said rack such that teeth of said pinion only partially engage into corresponding tooth gaps of said rack.

11. The rail system according to claim 10, wherein said limiting device includes a runner wheel configured to run on a running surface of a part arranged in a longitudinal direction of said rail system.

12. The rail system according to claim 11, wherein said runner wheel is mounted coaxially with an axis of rotation of said pinion.

13. The rail system according to claim 12, wherein said part comprises an elongated elastic spacer part extending along said rack, said runner wheel running on said running surface of said elongated elastic spacer part so as to limit engagement of said teeth of said pinion with said tooth gaps of said rack.

14. The rail system according to claim 10, wherein said limiting device has a limb to be engaged under said rack so as to limit a lift-off height of said pinion relative to said rack.

15. An arrangement comprising:

two rail systems, each of said two rail systems including:

a carcass rail to be fastened to a furniture carcass;

a drawer rail movable relative to said carcass rail; and a rack arranged on one of said carcass rail or said drawer rail, said rack being mounted so as to be pivotable about a longitudinal extension axis of said rail system with respect to said one of said carcass rail or said drawer rail such that said rack is limitedly movable in a heightwise direction in a mounted condition, said longitudinal extension axis extending in an extension direction of said rail system, said two rail systems to be fastened to opposite side walls of an article of furniture; and a synchronization bar for connecting together said two rail systems for transmission of a synchronous movement, said synchronization bar including a pinion engaging into a respective rack of each of said rail systems.

16. An article of furniture comprising:

said furniture carcass; and an arrangement according to claim 15, wherein said carcass rail is fastened to said furniture carcass.

* * * * *